United States Patent [19]

Smith et al.

[11] Patent Number: 4,968,281

[45] Date of Patent: Nov. 6, 1990

[54] TOY ANIMAL WITH SUPPLE LEGS AND WEIGHTED FEET

[75] Inventors: Shari L. Smith, Chicago; Howard J. Morrison, Riverwoods, both of Ill.

[73] Assignee: Tiger Electronics, Inc., Vernon Hills, Ill.

[21] Appl. No.: 444,448

[22] Filed: Dec. 1, 1989

[51] Int. Cl.[5] ..... A63H 3/02; A63H 3/36

[52] U.S. Cl. ..... 446/369; 446/390

[58] Field of Search ..... 446/369, 368, 370, 371, 446/372, 373, 374, 385, 390, 396

[56] References Cited

U.S. PATENT DOCUMENTS

| | | | |
|---|---|---|---|
| D. 83,218 | 2/1931 | Seror | 446/369 X |
| 1,659,720 | 2/1928 | Cate | 446/369 |
| 2,252,077 | 8/1941 | Katz | 446/369 |
| 2,274,303 | 2/1942 | Ornstein | 446/369 X |
| 2,347,405 | 4/1944 | Ford | 446/369 |
| 2,997,810 | 8/1961 | Bellas | 446/369 |
| 3,678,616 | 7/1972 | Goldfarb et al. | 446/371 |
| 3,748,779 | 7/1973 | Cherk et al. | 446/370 |
| 3,882,633 | 5/1975 | Goldfarb et al. | 446/369 |
| 3,966,121 | 8/1976 | Goldfarb et al. | 446/369 |
| 4,296,567 | 10/1981 | Kamar | 446/369 |
| 4,563,159 | 1/1986 | Hills et al. | 446/369 X |
| 4,575,351 | 3/1986 | Gonzalez | 446/371 |
| 4,582,499 | 4/1986 | Saigo et al. | 446/372 X |
| 4,648,851 | 3/1987 | Rosenberg | 446/369 X |
| 4,755,160 | 7/1988 | Autore | 446/369 |
| 4,758,200 | 7/1988 | Von Moltke | 446/371 |
| 4,884,991 | 12/1989 | Terzian | 446/369 |

FOREIGN PATENT DOCUMENTS

| | | | |
|---|---|---|---|
| 322222 | 12/1929 | United Kingdom | 446/373 |
| 984694 | 3/1965 | United Kingdom | 446/373 |

*Primary Examiner*—Robert A. Hafer
*Assistant Examiner*—D. Neal Muir
*Attorney, Agent, or Firm*—Dressler, Goldsmith, Shore, Sutker & Milnamow, Ltd.

[57] ABSTRACT

A toy animal having a body, at least two disproportionately long, supple legs extending downwardly from the body and at least one additional appendage extending downwardly therefrom. Each leg has a pad-like foot, which is weighted by a mass of polyethylene beads so as to cause such leg to dangle downwardly when the toy animal is held above an underlying surface. Although the legs lend a lanky appearance to the toy animal, the legs and the additional appendage or appendages extending downwardly from the body have sufficient columnar strength to support the toy animal and to resist collapsing when the toy animal is rested on a horizontal surface.

16 Claims, 1 Drawing Sheet

TOY ANIMAL WITH SUPPLE LEGS AND WEIGHTED FEET

TECHNICAL FIELD OF THE INVENTION

This invention pertains to a toy animal, such as a stuffed animal, which has supple legs and weighted feet.

BACKGROUND OF THE INVENTION

Toy animals, such as stuffed animals, provide countless children with innumerable hours of enjoyment. Small children and their parents are drawn to toy animals that have whimsical shapes and that respond in amusing ways to being handled.

It has been a continuing challenge to toy designers to develop new versions of toy animals appealing to small children and their parents. This invention is addressed to that challenge.

SUMMARY OF THE INVENTION

This invention provides a toy animal that may appear to be inherently unstable when rested on a horizontal surface, such as a table top or a floor, but that tends to be quite stable when rested on such a surface. Moreover, the toy animal responds in amusing ways to be handled.

Basically, the toy animal has a body and plural appendages, which extend downwardly from the body. Moreover, the toy animal may have other appendages extending from the body, such as a tail or a head with eyes, ears, whiskers, or other features.

The appendages extending downwardly from the body include two or more disproportionately long, supple legs, which lend a lanky appearance to the toy animal, and may include at least one additional appendage, which may be a tail or another such leg. Each such leg comprises and terminates in a foot, which is pad-like, and which is larger in cross-section when compared to other portions of the same leg.

Each foot is weighted so as to cause the leg comprising such foot to dangle downwardly when the toy animal is held above an underlying surface. Although the disproportionately long, supple legs lend a lanky appearance to the toy animal, such legs and the other appendage or other appendages have sufficient columnar strength to support the toy animal and to resist collapsing when the toy animal is rested on a horizontal surface, such as a table top or a floor, with each foot bearing on the horizontal surface and with any additional downwardly exending appendage bearing on the horizontal surface.

If the toy animal has two such legs, the additional downwardly extending appendage may be a tail. Thus, the toy animal may represent a bird standing on its two legs and leaning on its tail. Also, the toy animal may represent a kangaroo, a squirrel, a dinosaur, or some other four-legged, long-tailed animal standing on its hind legs and leaning on its tail.

Alternatively, the toy animal may have four such legs, whereupon it may represent any of a myriad of species of four-legged animals standing on their four legs. Conceivably, the toy animal may have six such legs, whereupon it may represent an insect, or eight such legs, whereupon it may represent a spider or an octopus.

In most instances, the supple legs of the toy animal tend to be disproportionately long for the body of the toy animal, particularly when compared to the true proportions of any actual animal represented by the toy animal. Thus, the toy animal appears to be inherently unstable, particularly when standing on the disproportionately long, supple legs. However, the toy animal may represent a fantastic animal, such as a unicorn, rather than any actual animal.

Preferably, each foot is weighted by a mass of particulate material, such as a mass of polyethylene or other polymeric beads or a mass of silica particles. It is preferred, moreover, that each leg has a fabric cover, that each foot has a bag within the fabric cover of the leg comprising such foot, and that the bag within each foot contains such a mass weighting such foot.

Furthermore, as a preferred feature, portions of the body and portions of the legs, except for the feet, are stuffed so that the feet are denser than the stuffed portions of the legs, and so that the stuffed portions of the legs are denser than the stuffed portions of the body.

These and other objects, features, and advantages of this invention are evident from the following description of the alternative embodiments of this invention.

DETAILED DESCRIPTION OF ILLUSTRATED EMBODIMENTS

Figure 1:
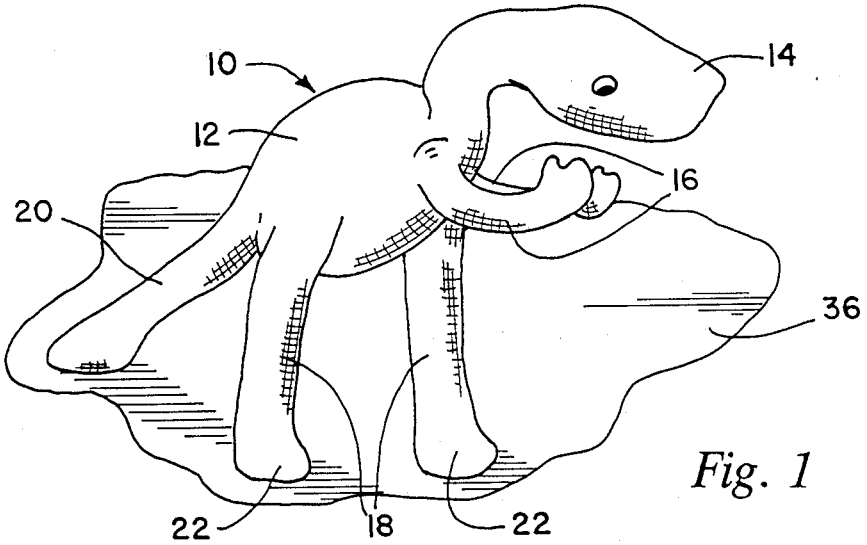
FIG. 1 is a perspective view of a toy dinosaur standing on its hind legs and leaning on its tail, on a horizontal surface.

Two of a myriad of possible embodiments of this invention are illustrated in the drawings and are to be hereinafter described. It is to be understood that these are exemplary only and that this invention is not limited to the illustrated embodiments.

As shown in FIG. 1, this invention may be embodied in a toy dinosaur 10. The toy dinosaur 10 has a whimsical appearance.

The toy dinosaur 10 has a soft, sculptured body 12, a soft, sculptured head 14 extending forwardly from the body 12 and having eyes and other features, two forelegs 16 extending forwardly from the body 12, two hind legs 18 extending downwardly from the body 12, and a large tail 20 extending backwardly and downwardly from the body 12.

The hind legs 18 are disproportionately long, as well as supple, so as to lend a lanky appearance to the toy dinosaur 10, and so as to cause the toy dinosaur 10 to respond in amusing ways when handled. Each hind leg 18 comprises and terminates in a foot 22, which is pad-like, and which is larger in cross-section when compared to other portions of such hind leg 18.

The body, head, legs, and tail of the toy dinosaur 10 are covered (except for external features, such as eyes) with a woven, stretchable, textile cover 24, such as a woven, nylon cover, which may be brightly colored. The stretchable cover 24 enables the toy dinosaur 10 to assume various comic or uncanny poses. All so-covered portions of the body, head, legs, and tail of the toy animal 10, except for the feet 22, and except for a distal portion of the tail 20 if such portion is weighted in a manner noted below, are stuffed with a pillow-stuffing material 26. Quallofil TM pillow-stuffing material, which is a synthetic, downy, fibrous material available commercially from E. I. du Pont de Nemours and Company, Wilmington, Del., is preferred.

In comparative terms, the hind legs 18 are more densely stuffed, whereas other stuffed portions of the toy dinosaur are less densely stuffed.

Figure 2:
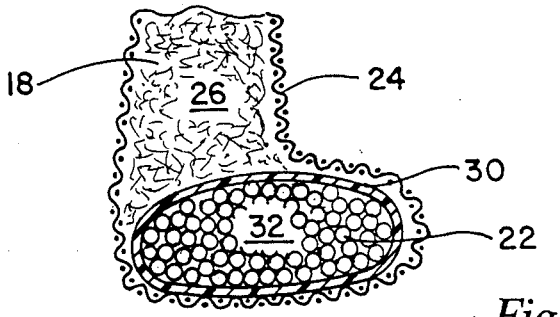
FIG. 2 is a fragmentary, cross-sectional view of an exemplary one of the hind legs of the toy dinosaur of FIG. 1.

As shown in FIG. 2, each foot 22 contains a bag 30, which is filled with a mass 32 of translucent, polyethylene beads, silica particles, or other, particulate material. The mass 32 weights such foot 22. The bag 30 is made of heat-sealable, polymeric film, which is heat-sealed to close the bag 30 after the bag 30 has been filled. The bag 30 may be sewn into such foot 22.

Each foot 22 is weighted by such a mass 32 contained by such a bag 30, so as to cause the hind leg 18 comprising such foot 22 to dangle downwardly when the toy dinosaur 10 is held above an underlying surface, such as the horizontal surface 36 shown fragmentarily in FIG. 1. The distal portion of the tail 20 may be weighted by such a mass (not shown) contained in such a bag (not shown) sewn into the distal portion of the tail 20.

In comparative terms, the feet 22 (and the distal portion of the tail 20 if such portion of the tail 20 is weighted in the manner noted above) are denser than the stuffed portions of the hind legs 18, and the hind legs 18 are denser than other stuffed portions of the toy dinosaur 10.

Although the hind legs 18 lend a lanky appearance to the toy dinosaur 10, the hind legs 18 and the large tail 20 (whether or not weighted in the manner noted above) have sufficient columnar strength to support the toy dinosaur 10 and to resist collapsing when the toy dinosaur 10 is rested on a horizontal surface, such as the horizontal surface 36, with each foot 22 bearing on the horizontal surface and with the tail 20 bearing on the horizontal surface.

Figure 3:
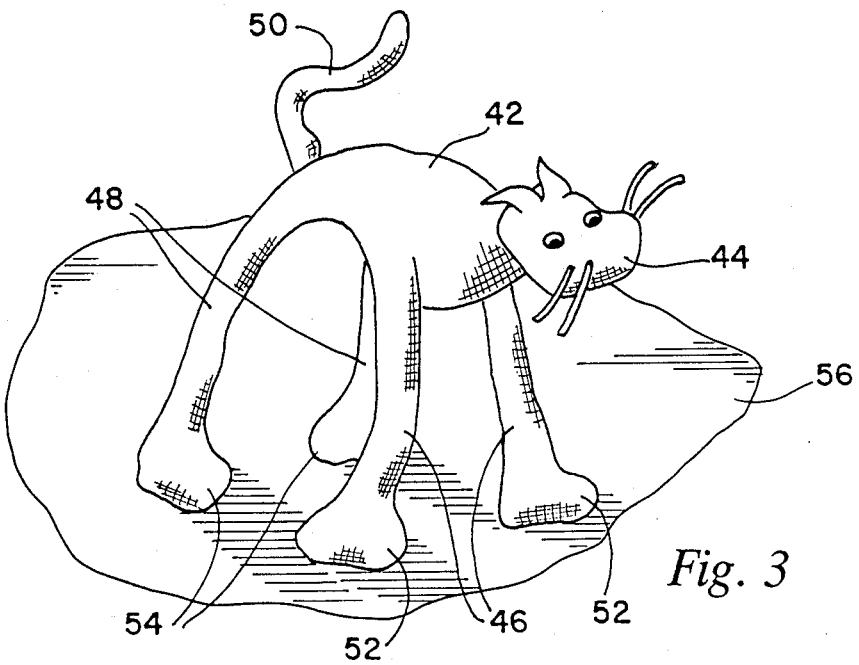
FIG. 3 is a perspective view of a toy cat standing on its four legs, on a horizontal surface.

As shown in FIG. 3, this invention may be embodied in a toy cat 40. The toy cat 40 also has a whimsical appearance.

The toy cat 40 has a soft, sculptured body 42, a soft, sculptured head 44 extending forwardly from the body 42 and having eyes, ears, whiskers, and other features, two forelegs 46 extending downwardly from the body 42, two hind legs 48 extending downwardly from the body 42, and a long tail 50 extending backwardly from the body 42 and curling in arbitrary directions.

The forelegs 46 and the hind legs 48 are disproportionately long, as well as supple, so as to lend a lanky appearance to the toy cat 40, and so as to cause the toy cat 40 to respond in amusing ways when handled. Each foreleg 46 comprises and terminates in a foot 52, which is pad-like, and which is larger in cross-section when compared to other portions of such foreleg 46. Similarly, each hind leg 48 comprises and terminates in a foot 54 which is similar to the foot 52 of each fore leg 46.

The body 42, the head 44, the forelegs 46, the hind legs 48, and the tail 40 are covered (except for external features, such as eyes, ears, and whiskers) with a fabric cover, which is similar to the fabric cover 24 used in the toy dinosaur 10. All so-covered portion of the body 42, the head 44, the forelegs 46, except for the feet 52, the hind legs 48, except for the feet 52, and the tail 50 are stuffed with a pillow-stuffing material, which is similar to the pillow-stuffing material used in the toy dinosaur 10.

In comparative terms, the fore- and hind legs of the toy cat 40 are more densely stuffed, whereas other stuffed portions of the toy cat 40 are less densely stuffed.

The feet 52 and the feet 54 are similar to the feet 22 of the toy dinosaur 10 (except possibly for minor aspects of their external shapes) and are weighted similarly by masses (not shown) of polyethylene beads contained by bags (not shown) similar to the bags 30.

Each foot 52 of the toy cat 40 is weighted, as mentioned above, so as to cause the fore- or hind leg comprising such foot 52 to dangle downwardly when the toy cat 40 is held above an underlying surface, such as the horizontal surface 56 shown fragmentarily in FIG. 3.

In comparative terms, the feet 52 are denser than the stuffed portions of the fore- and hind legs of the toy cat 40, and such legs are denser than other stuffed portions of the toy cat 40.

Although the fore- and hind legs lend a lanky appearance to the toy cat 40, the fore- and hind legs have sufficient columnar strength to support the toy cat 40 and to resist collapsing when the toy cat 40 is rested on a horizontal surface, such as the horizontal surface 60, with each foot 54 bearing on the horizontal surface and with each foot bearing on the horizontal surface.

When standing with its fore- and hind legs bearing on a horizontal surface, the toy cat 40 can be precipitously leaned in a forward, backward, or lateral direction (seeming to defy gravity) without falling over. The toy cat 40 can assume other comic or uncanny poses. If the toy cat 40 is dropped from a reasonable height onto a horizontal surface, the toy cat 40 tends to land on its fore- and hind legs, as a live cat tends to land.

Various modifications may be made in either of the toy animals illustrated and described herein without departing from the scope and spirit of this invention.

We claim:

1. A toy animal having a body and a plurality of appendages extending downwardly from the body, said appendages including at least two disproportionately long, supple legs lending a lanky appearance to the toy animal, said appendages including at least one additional appendage, each leg comprising and terminating in a pad-like foot larger in cross-section when compared to other portions of such leg, each foot being weighted by a mass of a first material so as to cause the leg comprising such foot to dangle downwardly when the toy animal is held by the body above an underlying surface, each appendage having a composite structure, which includes an outer fabric cover and inner stuffing material differing from the materials, which provides each leg with sufficient flexibility to dangle downwardly when the toy animal is held by the body above an underlying surface, and which provides said appendages with sufficient columnar strength to support the toy animal and to resist collapsing when the toy animal is rested on a horizontal surface with each foot bearing on the horizontal surface and with the additional appendage bearing on the horizontal surface, said first foot-weighting material being denser than said inner stuffing material, whereby the toy animal is stabilized when caused to assume various comic or uncanny poses.

2. The toy animal of claim 1 having two such legs and one such additional appendage being a tail.

3. The toy animal of claim 2 wherein each foot is weighted by a mass of particulate material.

4. The toy animal of claim 3 wherein the mass of particulate material comprises a mass of polymeric beads.

5. The toy animal of claim 2 wherein the outer fabric cover of each leg extends over the foot of such leg and wherein each foot has a bag within the fabric cover of such foot and is weighted by a mass of particulate material contained by the bag within such foot.

6. The toy animal of claim 5 wherein portions of the body and portions of the legs, except for the feet, are stuffed so that the feet are denser than the stuffed portions of the legs, and so that the stuffed portions of the legs are denser than the stuffed portions of the body.

7. The toy animal of claim 6 wherein the mass of particulate material comprises a mass of polymeric beads.

8. The toy animal of claim 1 wherein the outer fabric cover of the composite structure of each leg is made from a stretchable textile.

9. A toy animal having a body and a plurality of disproportionately long, supple legs extending downwardly from the body and lending a lanky appearance to the toy animal, each leg comprising and terminating in at pad-like foot larger in cross-section when compared to other portions of such leg, each foot being weighted by a mass of a first material so as to cause the leg comprising such foot to dangle downwardly when the toy animal is held by the body above an underlying surface, each leg having a composite structure, which includes an outer fabric cover and inner stuffing material differing from the first material, which provides each leg with sufficient flexibility to dangle downwardly when the toy animal is held by the body above an underlying surface, and which provides the legs with sufficient columnar strength to support the toy animal and to resist collapsing when the toy animal is rested on a horizontal surface with each foot bearing on the horizontal surface, said first foot-weighting material being denser than said inner stuffing materials, whereby the toy animal is stabilized when caused to assume various comic or uncanny poses.

10. The toy animal of claim 9 having four such legs.

11. The toy animal of claim 10 wherein each foot is weighted by a mass of particulate material.

12. The toy animal of claim 11 wherein the mass of particulate material comprises a mass of polymeric beads.

13. The toy animal of claim 10 wherein the outer fabric cover of each leg extends over the foot of such leg and wherein each foot has a bag within the fabric cover of such foot and is weighted by a mass of particulate material contained by the bag within such foot.

14. The toy animal of claim 13 wherein portions of the body and portions of the legs, except for the feet, are stuffed so that the feet are denser than the legs, and so that the stuffed portions of the legs are denser than the stuffed portions of the body.

15. The toy animal of claim 14 wherein the mass of particulate material comprises a mass of polymeric beads.

16. The toy animal of claim 9 wherein the outer fabric cover of the composite structure of each leg is made from a stretchable textile.

* * * * *